US007005041B2

(12) United States Patent
Best

(10) Patent No.: US 7,005,041 B2
(45) Date of Patent: Feb. 28, 2006

(54) PAPER MACHINE BELT AND METHOD FOR CREATING A CONNECTION OF THE END EDGES OF SUCH A PAPER MACHINE BELT

(75) Inventor: Walter Best, Duren (DE)

(73) Assignee: Heimbach GmbH & Co., Duren (DE)

( * ) Notice: Subject to any disclaimer, the term of this patent is extended or adjusted under 35 U.S.C. 154(b) by 271 days.

(21) Appl. No.: 10/423,026

(22) Filed: Apr. 25, 2003

(65) Prior Publication Data

US 2004/0003862 A1 Jan. 8, 2004

(30) Foreign Application Priority Data

Apr. 25, 2002 (DE) ..... 202 06 659 U

(51) Int. Cl.
*D21F 7/08* (2006.01)
*D21F 7/12* (2006.01)
*D21F 1/10* (2006.01)

(52) U.S. Cl. ..... 162/358.2; 162/348; 162/900; 162/903; 162/904; 428/58; 24/33 R

(58) Field of Classification Search ..... 162/116, 162/117, 199, 205–207, 348, 358.2, 900, 162/902–904; 139/383 A, 425 A, 383 AA; 245/10; 28/110, 142; 428/58, 192–194; 24/33 R
See application file for complete search history.

(56) References Cited

U.S. PATENT DOCUMENTS

| | | | | |
|---|---|---|---|---|
| 2,077,891 A | | 4/1937 | Milnes | |
| 3,309,790 A | | 3/1967 | MacBean | |
| 3,972,105 A | | 8/1976 | Miller et al. | |
| 4,123,022 A | * | 10/1978 | Dutt et al. | 245/10 |
| 4,344,209 A | | 8/1982 | Harwood | |
| 4,364,421 A | * | 12/1982 | Martin | 139/383 AA |
| 4,574,435 A | | 3/1986 | Luciano et al. | |
| 5,148,838 A | | 9/1992 | Lee | |
| 5,707,496 A | * | 1/1998 | Johnson et al. | 162/348 |
| 5,746,257 A | * | 5/1998 | Fry | 139/383 AA |
| 6,328,079 B1 | * | 12/2001 | Zils | 139/383 AA |

FOREIGN PATENT DOCUMENTS

| | | |
|---|---|---|
| DE | 2256244 | 5/1972 |
| DE | 19944864 A1 | 5/2001 |
| EP | 0185907 | 10/1989 |
| EP | 0564436 A1 | 10/1993 |
| GB | 2231838 A | 11/1990 |
| WO | WO96/34146 | 10/1996 |

* cited by examiner

*Primary Examiner*—Eric Hug
(74) *Attorney, Agent, or Firm*—Berenato, White & Stavish, LLC

(57) ABSTRACT

The invention concerns a paper machine belt (1) having end edges (6, 7) extending transversely to the running direction, and having longitudinal yarns (3) that go as far as the end edges (6, 7), the end edges (6, 7) being connected to one another by way of a coupling device (8; 31; 41) that has complementary coupling elements (9, 10; 32, 33; 42, 43) which are connected to longitudinal yarns (3) and to which are attached coupling members (26; 35, 36; 45, 46) that are connected to one another in hinge-like fashion. The paper machine belt is characterized in that on at least one of the end edges (6, 7), the coupling element(s) (9, 10; 32, 33; 42, 43) is/are connected to the longitudinal yarns (3) via insertion connections. The invention furthermore refers to a method for creating a connection of the end edges (6, 7) of such a paper machine belt (1).

28 Claims, 4 Drawing Sheets

PAPER MACHINE BELT AND METHOD FOR CREATING A CONNECTION OF THE END EDGES OF SUCH A PAPER MACHINE BELT

The invention concerns a paper machine belt having end edges extending transversely to the running direction, and having longitudinal yarns that go as far as the end edges, the end edges being connected to one another by way of a coupling device that has complementary coupling elements which are connected to longitudinal yarns and to which are attached a series of coupling members that are connected to one another in hinge-like fashion. The invention also concerns a method for creating a connection of the end edges of such a paper machine belt.

In paper machines, long and wide belts that circulate in the paper machine and support the paper web are used. These are usually textile felts or screens having as their base a woven or knitted fabric. For the production of felts, one or more fiber layers are needled onto this base. Felts of this kind are used in particular in the press section of a paper machines, whereas screens are used in the sheet-forming area and the dryer section.

In many cases the paper machine belts are produced not on an endless basis but in a specific length. The edges on the end faces are then connected to one another via a seam, either before introduction into the paper machine or not until they are in the paper machine itself. The is so-called inserted-wire seam has proven particularly successful here. In this seam, a plurality of coupling loops are provided at end edges of the belt that face toward one another; for closure, these loops are caused to overlap in such a way that they engage in comb fashion into one another, and a continuous channel extending in the transverse direction of the belt is formed. Into this continuous channel a coupling wire is then inserted, connecting the two ends of the belt in the manner of a hinge.

A number of systems for configuring the coupling loops are known. For example, the coupling loops can be formed by looping back the end regions of the paper machine belt (U.S. Pat. No. 2,077,891; U.S. Pat. No. 3,309,790). Individual yarns can also be looped back and re-woven (U.S. Pat. No. 5,148,838).

Alternatively, the coupling loops can be constituted by U-shaped clamps that hook into the ends of the belt. The seams produced using such coupling loops are referred to as clipper seams (DE-A-2,256,244; U.S. Pat. No. 4,344,209). It is also known from U.S. Pat. No. 3,972,105 to form each of the coupling loops using a U-shaped sheet-metal part, the limbs of each sheet-metal part being connected to the associated end of the belt. A plurality of cutouts are shaped into the sheet-metal parts, thus producing coupling projections with the coupling loops.

Another alternative consists in constituting each of the coupling loops by means of a coupling coil extending beyond the end edges (U.S. Pat. No. 4,574,435; EP-B-0 185 907; EP-A-0 564 436). Connection of the coils to the ends of the paper machine belt occurs either by means of special seam yarns or by means of the belt's longitudinal yarns themselves, by looping them around the turns of the coil.

Also known as coupling elements forming coupling loops, instead of spiral coils, are particular shaped elements made of plastic, which are each connected to the longitudinal yarns of the paper machine clothing (cf. WO 96/34146; DE-A-199 44 864; GB-A-2 231 838). For that purpose, the longitudinal yarns are looped back and usually re-woven.

With the known approaches, connection of the coupling elements to the end edges of the paper machine clothing is labor- and time-intensive. It is furthermore difficult to cause all of the coupling loops, over the great width of the paper machine clothing, to overlap in such a way that a coupling wire can be inserted easily and without escaping. This is especially true in cases in which the end edges of the paper machine clothing are not coupled to one another until it is in the paper machine.

It is consequently the object of the present invention to configure the coupling device in a paper machine clothing of the kind cited initially in such a way that connection of the end edges of the paper machine clothing can be performed in a simple and time-saving manner.

This object is achieved, according to the present invention, in that on at least one of the longitudinal edges, preferably both longitudinal edges, the coupling element(s) is/are connected to the longitudinal yarns via insertion connections. The basic idea of the invention is thus to configure the longitudinal yarns and coupling elements that are to be connected to one another in such a way that they can be inserted into one another. This makes possible rapid coupling of the end edges of the paper machine clothing. It is not necessary for the longitudinal yarns to be looped back and re-woven. The insertion connection can be made with all or only some of the longitudinal yarns.

The coupling elements are advantageously embodied as simple coupling bars which extend over the entire width of the paper machine clothing or also over only a portion thereof. In the latter case, several coupling bars can be arranged next to one another at each end edge, each coupling bar extending only over a portion of the longitudinal yarns and being connected to them. This can even extend to the fact that a plurality of complementary coupling elements are provided next to one another when viewed in the widthwise direction, each connecting the ends of only one longitudinal yarn.

The insertion connections can be constituted by pins that are connected to the coupling elements, in particular are shaped onto them, and by yarn recesses, complementary to the pins, in the longitudinal yarns, into which the pins are inserted. It is especially advantageous in this context if the pins are held in the recesses by way of snap-lock devices, so that they cannot become detached after the insertion connections have been made. The snap-lock devices can comprise, for example, mutually complementary snap-lock projections and recesses, in which context the pins can have annular grooves as snap-lock recesses, and the yarn recesses can have annular ridges, fitting into the snap-lock grooves, as snap-lock projections.

In order to prevent the yarn recesses from expanding, they should be surrounded by reinforced walls, for example in the form of reinforcing sleeves made preferably of metal. The reinforcing sleeves can have collars at one or both ends that are recessed into the material of the longitudinal yarns in such a way that they do not project beyond their cross section, i.e. they terminate flush with the yarn surfaces.

The pins and yarn recesses can be shaped as desired, within wide limits. Round or polygonal cross sections are to be preferred, and the cross sections should be constant over the length of the pins and yarn recesses.

In order to improve the connection between the coupling device and the longitudinal yarns, it is useful if a transverse yarn that has orifices in the region of the pins and is connected to the longitudinal yarns, in particular is fused or adhesively bonded, runs between the coupling elements and the longitudinal yarns. The transverse yarn or yarns ensure uniform spacing of the yarn recesses in the longitudinal yarns, and thereby simplify production of the insertion connection.

According to a further feature of the invention, provision is made for the longitudinal and/or transverse yarns to have a rectangular cross section. It is further advantageous if the longitudinal and transverse yarns form yarn layers, the transverse yarns extending over the side of the longitudinal yarns on which the coupling elements are placed. The longitudinal and transverse yarns can be fused or adhesively bonded to one another at their crossing points. Fusing is accomplished by the action of heat on the yarns, which are made of a thermoplastic.

The thickness of the transverse yarns should correspond, on the side of the coupling elements, to the thickness of the coupling elements, optionally plus the thickness of the transverse yarns between the coupling elements and longitudinal yarns. This prevents the coupling elements from protruding. The coupling elements and coupling members should preferably be configured so that the permeability in the region of the coupling device is equal to the permeability in the remaining region of the paper machine clothing. The reason is that fluctuations in the permeability of the paper machine belt have disadvantageous consequences in terms of paper quality. To achieve uniform permeability, the width of the transverse yarns in the plane of the paper belt should be equal to the extension of the coupling device in the longitudinal direction of the paper machine belt.

The coupling members are advantageously embodied as coupling loops, aligned with one another, through which extend a coupling wire preferably made of a plastic. The length of the coupling loops should correspond to the width of the longitudinal yarns, and the coupling loops should be arranged as continuations of the longitudinal yarns.

Instead of this, however, provision can also be made for a coupling member of the one coupling element and an adjacent coupling member of the other coupling element to form respective member pairs which are inserted in hinge-like fashion into one another. This can occur, for example, by the fact that the one coupling member of a member pair has a peg that fits into a complementary recess in the other coupling member of that member pair. The pegs should be snap-locked into the recesses in such a way that the coupling members remain pivotable in hinge-like fashion with respect to one another, but are not axially displaceable with respect to one another.

The configuration according to the present invention of the connection of the coupling device allows the coupling device to be already preassembled before it is connected to the paper machine belt, by coupling the coupling elements to one another via the coupling members. Connection of the coupling elements to the longitudinal yarns can then be performed in such a way that the one coupling element and the associated longitudinal yarns are connected to one another, preferably by being inserted into one another; and that then the other coupling element is pivoted toward its associated longitudinal yarns and is connected to the longitudinal yarn by insertion. As an alternative to this, the possibility exists of inserting both coupling elements simultaneously into the longitudinal yarns, advantageously beginning at one side of the paper machine belt and then gradually toward the other side.

In the drawings, in which the invention is elucidated in more detail with reference to exemplary embodiments:

Figure 1:
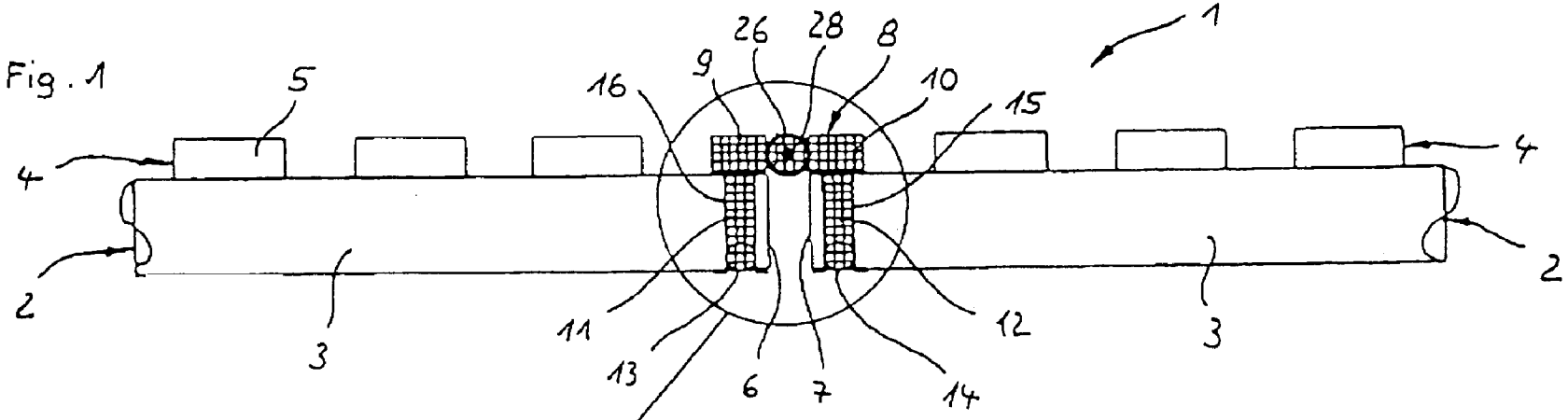
FIG. 1 is a longitudinal section through the end regions of a paper machine belt.
Figure 2:
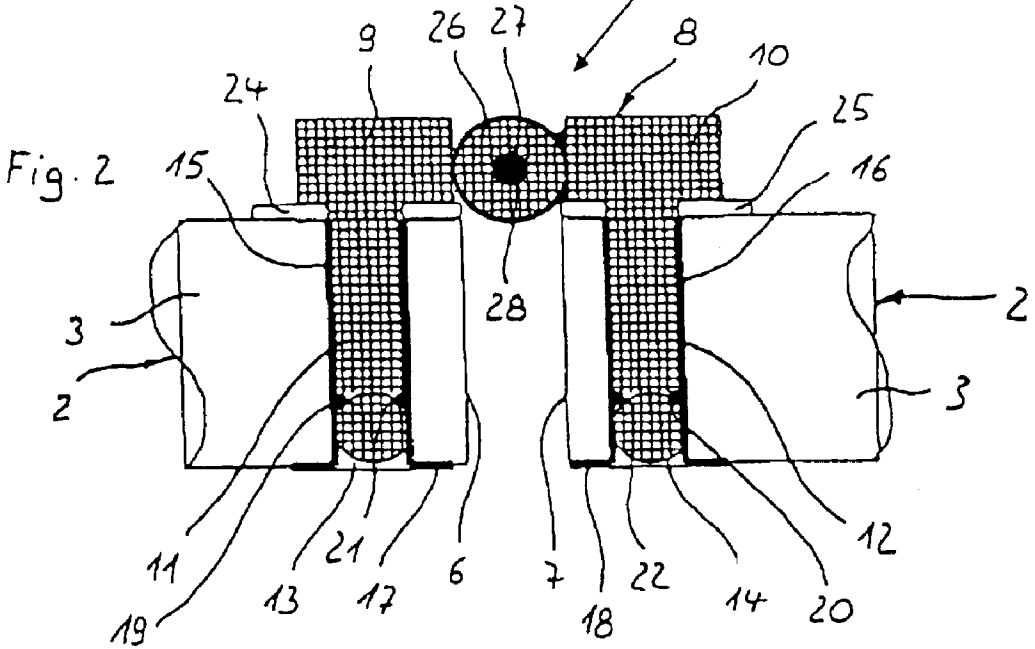
FIG. 2 is an enlarged portion of what is depicted in FIG. 1, showing a first coupling device.
Figure 3:
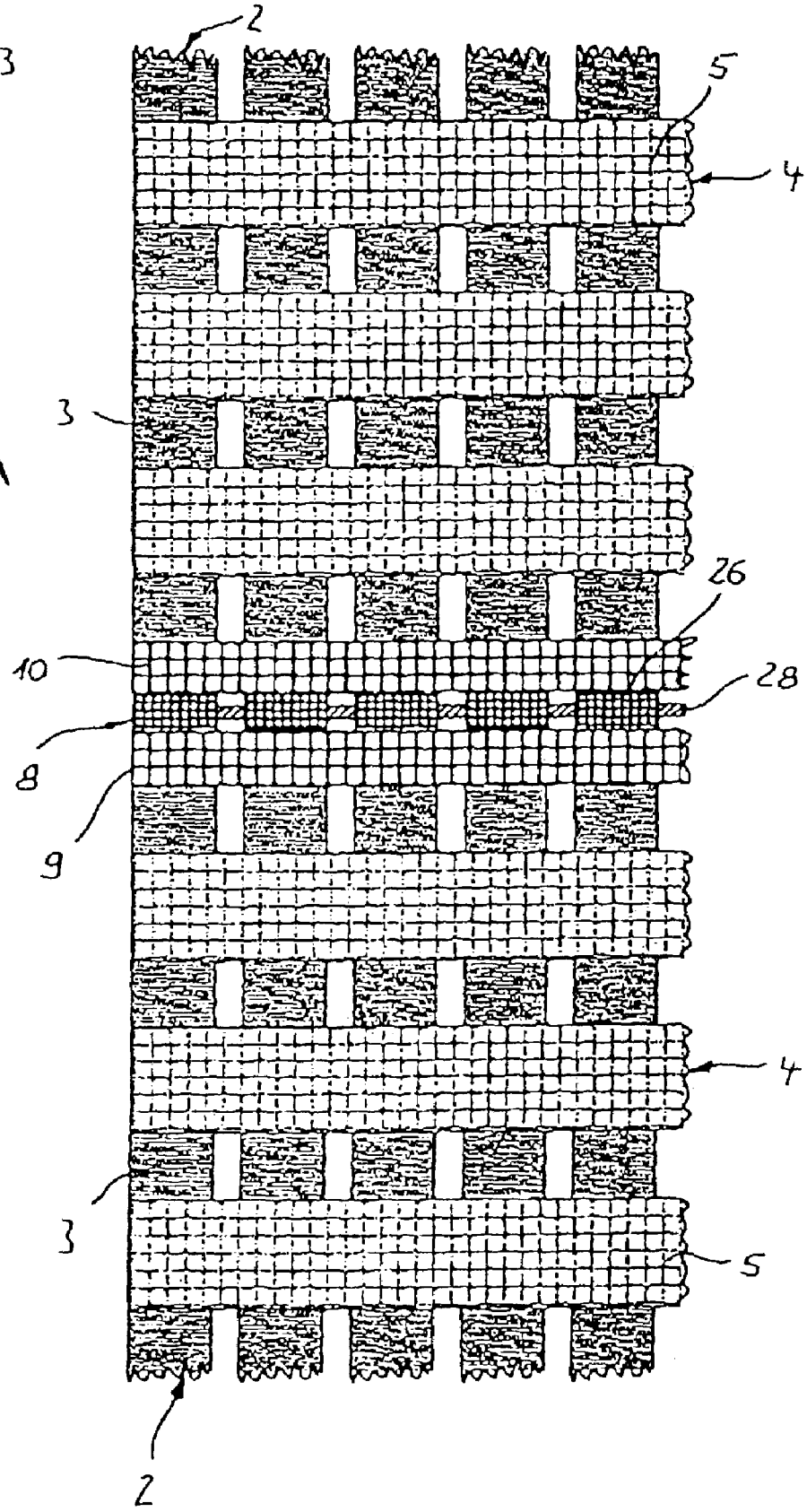
FIG. 3 is a partial plan view of the end regions of the paper machine belt according to FIGS. 1 and 2.

Paper machine belt 1 depicted in FIGS. 1 through 3 substantially comprises a lower-side longitudinal yarn layer 2 having longitudinal yarns (labeled 3 by way of example) running spaced apart next to one another, and a transverse yarn layer 4 arranged thereabove having transverse yarns (labeled 5 by way of example) also running spaced apart from one another, which rest on longitudinal yarns 3. Longitudinal and transverse yarns 3, 5 have a rectangular cross section and are fused to one another at the crossing points. They are made of a thermoplastic, for example PET, PA in all its modifications, PPS, PEK, PEEK, elastic polyester, PBT, or PTT, or combinations thereof. Fusing is accomplished by heating, limited to the crossing points, to the melting temperature and subsequent cooling. Heating can be performed, for example, using a laser.

In FIGS. 1 through 3, the two end regions of paper machine belt 1 are brought together so that their end faces are opposite to one another. End edges 6, 7 are constituted by the ends of longitudinal yarns 3, i.e. by longitudinal yarn layer 2. A coupling device 8 which extends over the entire width of paper machine belt 1 is provided in order to connect end edges 6, 7. Coupling device 8 has two coupling bars 9, 10, the one coupling bar 9 extending over the left-side ends of longitudinal yarns 3 and the other coupling bar 10 over the right-side ends of longitudinal yarns 3. A plurality of pins 11, 12 are shaped onto the lower side of coupling bars 9, 10. One pair of pins 11, 12 is associated with each longitudinal yarn 3, i.e. pins 11, 12 have—viewed in the longitudinal direction of coupling bars 9, 10—the same center-to-center spacing as longitudinal yarns 3. Pins 11, 12 have a circular cross section with a diameter that is constant over their length.

Pins 11, 12 are inserted into transverse holes 13, 14, complementary thereto, that pass vertically through longitudinal yarns 3 and are distributed over the entire width of the paper machine belt. Metal sleeves 15, 16 are inserted from below into transverse holes 13, 14 in order to reinforce them. Metal sleeves 15, 16 each have on the lower side a collar 17, 18 that is pressed into the material of longitudinal yarns 3 so that collars 17, 18 do not project beyond the lower sides of longitudinal yarns 3. Metal sleeves 15, 16 pass through the entire height of transverse holes 13, 14.

In the lower region, metal sleeves 15, 16 each have an annular ridge 19, 20. Annular ridges 19, 20 correspond to annular grooves 21, 22 in pins 11, 12, and constitute snap-lock devices with them. Upon insertion of pins 11, 12 into metal sleeves 15, 16, the lower regions of pins 11, 12 travel over annular ridges 19, 20 until annular grooves 21, 22 enter into a snap-lock connection with annular ridges 19, 20. An immovable axial connection between pins 11, 12 and metal sleeves 15, 16 is thereby created.

Between coupling bars 9, 10 and longitudinal yarns 3, additional flat transverse yarns 24, 25 extend over the entire width of paper machine belt 1. Transverse yarns 24, 25 are fused to longitudinal yarns 3 at the crossing points, thus additionally stabilizing the ends of longitudinal yarns 3 and establishing their spacing from one another.

Coupling loops (labeled 26 by way of example) are shaped onto the mutually opposing sides of coupling bars 9, 10, specifically (viewed over the width of paper machine belt 1) alternately one coupling loop 26 on the one coupling bar 9 and an adjacent coupling loop 26 on the other coupling bar 10. As is evident from FIG. 3, coupling loops 26 mesh in comb fashion with one another, so that their passthrough openings 27 align with one another. The width of coupling loops 26 corresponds to that of longitudinal yarns 3, and they are attached to coupling bars 9, 10 as continuations of longitudinal yarns 3 and at a spacing corresponding to the spacing of longitudinal yarns 3. A coupling wire 28 extending over the entire width of paper machine belt 1 is inserted through passthrough openings 27. It connects coupling loops 26 and therefore coupling bars 9, 10 and ultimately end edges 6, 7 of paper machine 1 in hinge-like fashion.

Coupling of the ends of paper machine belt 1 can be accomplished by the fact that coupling device 8 is first pre-assembled by causing coupling loops 26 to overlap and inserting coupling wire 28 through passthrough openings 27. Then, firstly, pins 11 of coupling bar 9 are inserted into transverse holes 13 of the left-side ends of longitudinal yarns 3, pins 12 of the other coupling bar 10 being swung up counterclockwise at a right angle to pins 11 of left-side coupling bar 9 so that they extend horizontally over the right-side ends of longitudinal yarns 3. After insertion of pins 11 of the left-side coupling bar 9 is complete, the right-side coupling bar 10, with pins 12, is pivoted clockwise downward toward transverse holes 14 in the right-side ends of longitudinal yarns 3, and pins 12 are successively inserted into transverse holes 14 or metal sleeves 16 until their annular grooves 22 are snap-locked with annular ridges 20 therein. The possibility exists, of course, of beginning insertion at the right-side ends of longitudinal yarns 3.

It is not excluded also to create the connection of the two ends of paper machine belt 1 using coupling device 8, in a manner known per se, by first connecting coupling bars 9, 10 to the ends of longitudinal yarns 3 by insertion, then bringing coupling loops 26 into overlapping alignment, and only then inserting coupling wire 28 into passthrough openings 27.

Figure 4:
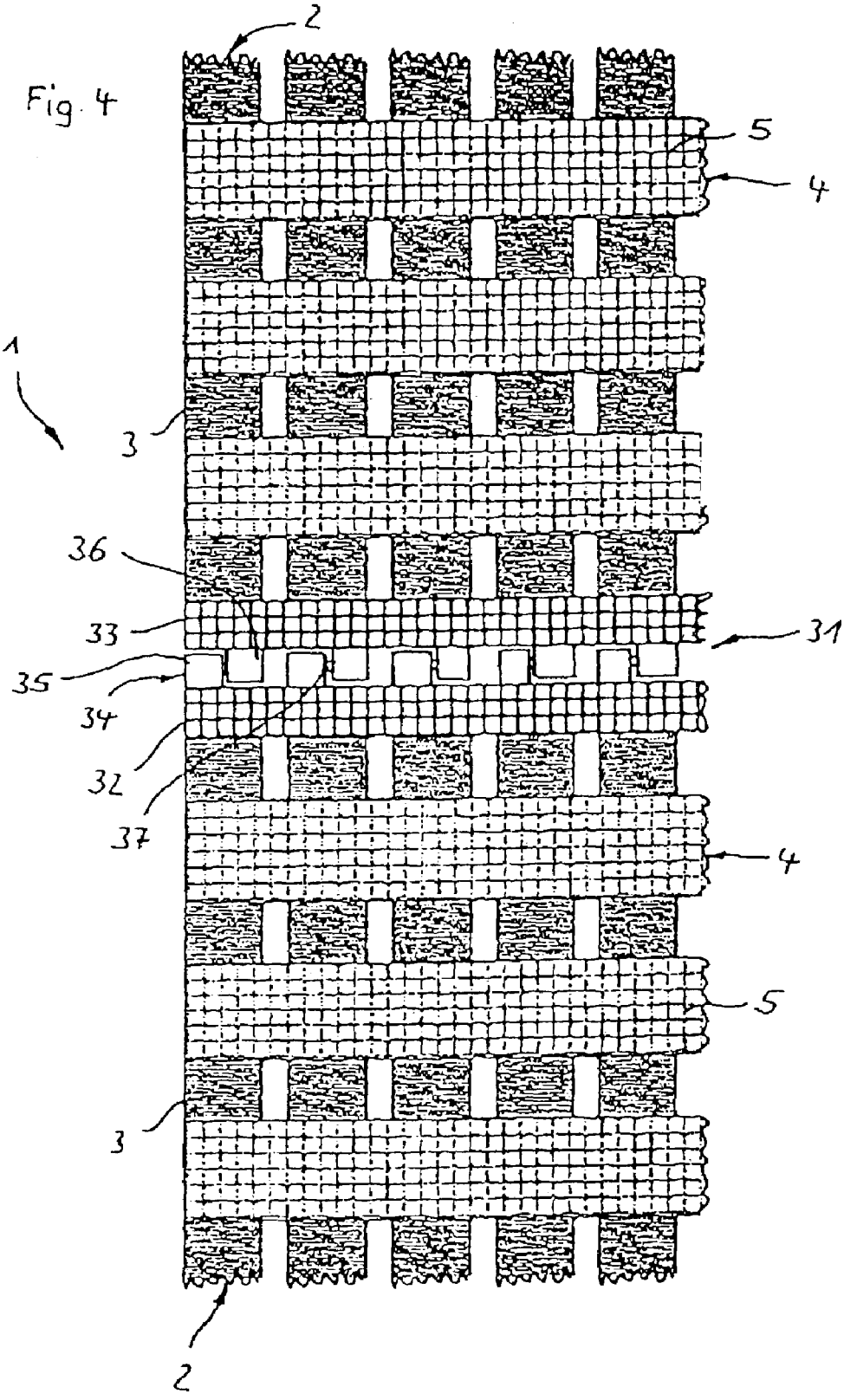
FIG. 4 is a partial plan view of the end regions of a paper machine belt having a second coupling device.

In FIG. 4, the ends of paper machine belt 1 are connected using a somewhat modified coupling device 31. Coupling device 31 differs from coupling device 8 only in that no coupling loops with passthrough openings are shaped onto coupling bars 32, 33, but rather a coupling member pair (labeled 34 by way of example) is provided instead of each coupling loop. Each coupling member pair 34 comprises two coupling members 35, 36, the one coupling member 35 being shaped onto the one coupling bar 32 and the other coupling member 36 onto the other coupling bar 33. Over the width of paper machine belt 1, coupling members 35, 36 are shaped alternately onto coupling bar 32 and onto coupling bar 33, i.e. a coupling member 35 shaped onto coupling bar 32 is followed by a coupling member 36 shaped onto the other coupling bar 33, and that in turn by a coupling member 35 shaped onto coupling bar 32.

Coupling members 35 have pegs 37, round in cross section and extending in the transverse direction of paper machine belt 1 toward the adjacent coupling member 36, that are inserted into complementary recesses in the adjacent coupling member 36 of coupling member pair 34. By way of pegs 37, a hinge-like connection that is strong in tension is created between the two coupling bars 32, 33 and thus ultimately between the ends of paper machine belt 1. Pegs 37 have a length which is less than the spacing between two adjacent coupling member pairs 34. It is thereby possible to cause coupling members 35, 36 to overlap for the purpose of assembling coupling device 31, and then to insert peg 37 into the openings of coupling members 36 by displacing coupling bars 32, 33 oppositely in the direction of their longitudinal extensions. Snap-lock connections can be provided, similarly to the snap-lock connections between pins 11, 12 and metal sleeves 15, 16 in coupling device 8 as shown in FIGS. 1 through 3. This prevents any displacement of coupling bars 32, 33 with respect to one another.

Coupling bars 32, 33 need not extend over the entire width of paper machine belt 1. Coupling device 31 can instead also be subdivided in such a way that coupling bars 32, 33 are divided, in the width direction of paper machine belt 1, into multiple coupling bar segments that each extend over only a limited number of longitudinal yarns 3.

Figure 5:
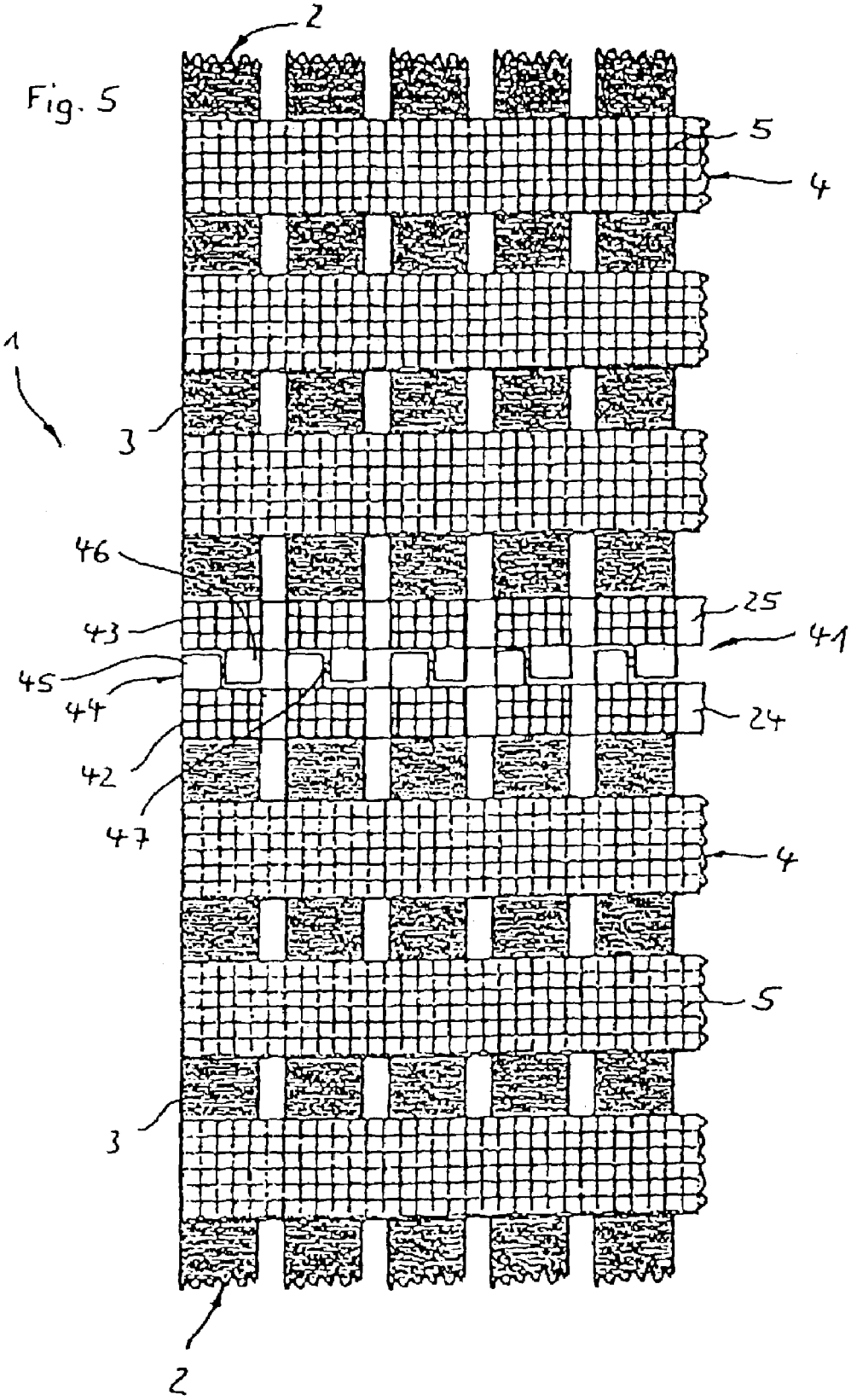
FIG. 5 is a partial plan view of the end regions of a paper machine belt having a third coupling device.

As is evident from FIG. 5, the segmentation can proceed to the point that the ends of each longitudinal yarn 3 are coupled to one another independently of the others. FIG. 5 shows the ends of paper machine belt 1 with a coupling device 41 that differs from the coupling device 31 shown in FIG. 4 only in that instead of coupling bars 32, 33, complementary individual coupling elements 42, 43 are provided in each case, each two complementary individual coupling elements 42, 43 connecting the ends of one longitudinal yarn 3. In the example depicted, the ends of each longitudinal yarn 3 are connected by two respective complementary individual coupling elements 42, 43. Individual coupling elements 42, 43 are connected to longitudinal yarns 3 via insertion connections, as is apparent from FIGS. 1 and 2.

Serving to connect each pair of complementary individual coupling elements 42, 43 is a respective coupling member pair (labeled 44 by way of example) that comprises two coupling members 45, 46 which are configured and arranged identically to coupling members 35, 36 in the case of coupling device 31 as shown in FIG. 4. The one coupling member 45 is shaped onto the one individual coupling element 42, and the other coupling member 46 onto the other individual coupling element 43. Coupling members 45 have pegs (labeled 47 by way of example), round in cross section and extending in the transverse direction of paper machine belt 1 toward the respectively adjacent coupling member 46, which are inserted into complementary recesses in the respectively adjacent coupling member 46. As in the exemplary embodiment according to FIG. 4, a hinge-like connection that is strong in tension is created between individual coupling elements 42, 43 by pegs 47.

It is understood that coupling device 31 according to FIG. 4 and coupling device 41 according to FIG. 5 can also be modified in such a way that their coupling members 35, 36 and 45, 46 merely have mutually aligning passthrough openings into which a coupling wire is then inserted, similarly to the embodiment shown in FIG. 3.

What is claimed is:

1. A paper machine belt (1) having end edges (6, 7) extending transversely to the running direction, and having longitudinal yarns (3) that go as far as the end edges (6, 7), the end edges (6, 7) being connected to one another by way of a coupling device (8; 31; 41) that has complementary coupling elements (9, 10; 32, 33; 42, 43) which are connected to longitudinal yarns (3) and to which are attached coupling members (26; 35, 36; 45, 46) that are connected to one another in hinge-like fashion, wherein on at least one of the end edges (6, 7), the coupling element(s) (9, 10; 32, 33; 42, 43) is/are directly inserted into the longitudinal yarns (3) via insertion connections.

2. The paper machine belt as defined in claim 1, wherein the coupling elements (9, 10; 32, 33) are connected via insertion connections to the longitudinal yarns (3) at both end edges (6, 7).

3. The paper machine belt as defined in claim 1, wherein the coupling elements are embodied as coupling bars (9, 10; 32, 33).

4. The paper machine belt as defined in claim 3, wherein the coupling bars extend over only a portion of the end edges (6, 7), and several coupling bars are aligned in sequence next to one another over each end edge (6, 7).

5. The paper machine belt as defined in claim 1, wherein several coupling elements (42, 43) are associated with each end edge (6, 7); and the respectively complementary coupling elements (42, 43) connect the ends of only a single longitudinal yarn (3).

6. The paper machine belt as defined in claim 1, wherein the insertion connections are constituted by pins (11, 12) that are connected to the coupling elements (9, 10; 32, 33; 42, 43) and by yarn recesses (13, 14), complementary to the pins (11, 12), in the longitudinal yarns (3), into which the pins (11, 12) are inserted.

7. The paper machine belt as defined in claim 6, wherein the pins (11, 12) are shaped onto the coupling elements (9, 10; 32, 33; 42, 43).

8. The paper machine belt as defined in claim 6, wherein the pins (11, 12) are held in the recesses (13, 14) by way of snap-lock devices (19, 20, 21, 22).

9. The paper machine belt as defined in claim 8, wherein the snap-lock devices comprise mutually complementary snap-lock projections (19, 20) and snap-lock recesses (21, 22).

10. The paper machine belt as defined in claim 9, wherein the pins (11, 12) have annular grooves (21, 22) as snap-lock recesses, and the yarn recesses (13, 14) have annular ridges (19, 20), fitting into the snap-lock grooves (21, 22), as snap-lock projections.

11. The paper machine belt as defined in claim 6, wherein the yarn recesses (13, 14) are surrounded by reinforced walls (15, 16).

12. The paper machine belt as defined in claim 11, wherein the reinforced walls are embodied as reinforcing sleeves (15, 16) inserted into the longitudinal yarns (3).

13. The paper machine belt as defined in claim 12, wherein the reinforcing sleeves (15, 16) have collars (17, 18) at one or both ends that are recessed into the material of the longitudinal yarns (3) in such a way that they do not project beyond their cross-sectional area.

14. The paper machine belt as defined in claim 6, wherein the pins (10, 11) and yarn recesses (13, 14) have a round or polygonal cross section.

15. The paper machine belt as defined in claim 1, wherein a transverse yarn (24, 25) that has orifices in the region of the insertion connections and is fused or adhesively bonded to the longitudinal yarns (3) runs between the coupling elements (9, 10; 32, 33) and the longitudinal yarns (3).

16. The paper machine belt as defined in claim 1, wherein the longitudinal yarns (3) and/or transverse yarns (5, 24, 25) have a rectangular cross section.

17. The paper machine belt as defined in claim 1, wherein the transverse yarns (5) and longitudinal yarns (3) form yarn layers (2, 4), the transverse yarns (5) extending over the side of the longitudinal yarns (3) on which the coupling elements (9, 10; 32, 33; 42, 43) are placed.

18. The paper machine belt as defined in claim 17, wherein the thickness of the transverse yarns (5) corresponds, on the side of the coupling elements (9, 10; 32, 33; 42, 43), to the thickness of the coupling elements (9, 10; 32, 33; 42, 43), optionally plus the thickness of the transverse yarns (24, 25) between the coupling elements (9, 10; 32, 33; 42, 43) and longitudinal yarns (3).

19. The paper machine belt as defined in claim 1, wherein the coupling elements (9, 10; 32, 33; 42, 43) and coupling members (26; 35, 36; 45, 46) are configured so that the permeability of the paper machine belt (1) in the region of the coupling device (8; 31) is equal to the permeability in the remaining region of the paper machine belt (1).

20. The paper machine belt as defined in claim 18, wherein the width of the transverse yarns (5) in the plane of the paper belt (1) is equal to the extension of the coupling device (8; 31; 41) in the longitudinal running direction of the paper machine belt (1).

21. The paper machine belt as defined in claim 1, wherein the coupling members are embodied as coupling loops (26), aligned with one another, through which a coupling wire (28) extends.

22. The paper machine belt as defined in claim 21, wherein the length of the coupling loops (26) corresponds to the width of the longitudinal yarns (3); and the coupling loops (26) are arranged as continuations of the longitudinal yarns (3).

23. The paper machine belt as defined in claim 1, wherein a coupling member (35; 45) of one coupling element (32; 42) and an adjacent coupling member (36; 46) of the opposite coupling element (33; 43) form respective member pairs (34; 44) which are inserted in hinge-like fashion into one another.

24. The paper machine belt as defined in claim 23, wherein the one coupling member (35; 45) of a member pair (34; 44) has a peg (37; 47) that fits into a complementary recess in the other coupling member (36; 46) of that member pair (34; 44).

25. The paper machine belt as defined in claim 24, wherein the pegs (37; 47) are snap-locked into the recesses in such a way that the coupling members (35, 36; 45, 46) are pivotable in hinge-like fashion with respect to one another, but are not axially displaceable with respect to one another.

26. A method for creating a connection of the end edges (6, 7) of a paper machine belt (1), as defined in claim 1, wherein firstly the coupling elements (9, 10; 32, 33; 42, 43) are coupled to one another in hinge-like fashion via the coupling members (26; 35, 36; 45, 46); and then they are connected to the longitudinal yarns (3) via insertion connections.

27. The method as defined in claim 26, wherein the coupling element(s) (9; 32; 42) and the longitudinal yarns (3) are connected to one another at one of the end edges (6, 7); and then the other coupling element(s) (10; 32; 42) is/are pivoted toward the longitudinal yarns (3) on the other end edge (6, 7) and brought into an insertion connection with those longitudinal yarns (3).

28. The method as defined in claim 26, wherein the complementary coupling elements (9, 10; 32, 33; 42, 43) are simultaneously inserted into the respectively opposite ends of the longitudinal yarns (3).

* * * * *